United States Patent [19]

Knapp

[11] 3,945,204

[45] Mar. 23, 1976

[54] PROCESS FOR THE DETOXIFICATION OF EXHAUST GASES

[75] Inventor: Heinrich Knapp, Leonberg-Silberberg, Germany

[73] Assignee: Robert Bosch GmbH, Stuttgart, Germany

[22] Filed: June 27, 1974

[21] Appl. No.: 483,816

[30] Foreign Application Priority Data

June 29, 1973 Germany ..... 2333072

[52] U.S. Cl. ..... 60/274; 60/276; 60/286; 60/301

[51] Int. Cl.[2] ..... F02B 75/10

[58] Field of Search ..... 60/276, 285, 286, 301, 60/274

[56] References Cited

UNITED STATES PATENTS

| | | | |
|---|---|---|---|
| 3,738,341 | 6/1973 | Loos | 60/285 |
| 3,768,259 | 10/1973 | Carnahan | 60/276 |
| 3,832,848 | 9/1974 | Scholl | 60/276 |
| 3,842,600 | 10/1974 | Nakajima | 60/276 |

*Primary Examiner*—Douglas Hart
*Attorney, Agent, or Firm*—Edwin E. Greigg

[57] ABSTRACT

A process for reducing the concentration of undesirable components in the exhaust gases of an internal combustion machine. The process provides injecting fuel into the hot exhaust gases within the exhaust system and controlling the quantity of this additional fuel by means of an oxygen sensor located within the exhaust system and by appropriate settings of the primary fuel metering system of the engine. A catalyzer unit for chemical interaction with the exhaust gases may also be provided.

3 Claims, 2 Drawing Figures

PROCESS FOR THE DETOXIFICATION OF EXHAUST GASES

BACKGROUND OF THE INVENTION

The invention relates to a process for the detoxification of the exhaust gases of an internal combustion engine including a fuel metering system which is controlled by an oxygen measuring sensor disposed on the exhaust side of the engine.

As is well known, the concentration of toxic hydrocarbon compounds and carbon monoxide is especially low in a slightly leaned-out air-fuel mixture. On the other hand, it is especially in this mixture domain that toxic nitrogen oxide components are present in large quantity. In richer air-fuel mixture domains, the nitrogen oxide components are present in lesser quantity. Thus, it has been proposed to operate a fuel metering system at a setting which provides a slightly enriched mixture, ($\lambda>1$) so that the exhaust gas will contain relatively few $NO_x$ components and to oxidize any remaining excess of carbon monoxide and hydrocarbon compounds by admitting a secondary stream of air to the exhaust gas. The parameter $\lambda$ is called the "air number" and is defined as being proportional to the ratio of the mass of air to the mass of fuel. When the air-fuel mixture is a stoichiometric mixture, $\lambda = 1.0$. Aside from the fact that such a process necessitates high fuel consumption, difficulties arise during the warm-up operation of the internal combustion engine and also when very low outside temperatures prevail, because under those conditions, regulartory deviations may occur due to the wide control region involved and the dead-time of the control process also becomes too large.

OBJECT AND SUMMARY OF INVENTION

It is an object of the invention to improve a process of the type disclosed above in such a way that the time constant of the corrective action within the regulator is as large as possible in the stationary case, so that the regulatory deviation during the dead-time does not become too large. On the other hand, the time constant must not be too large, so that, in the non-stationary case, after a deviation has occurred, the transition to the new $\lambda = 1$ state can occur sufficiently rapidly. It must also be considered that the transition time of the engine is rpm-dependent and also load-dependent owing to the moving gas volume between the exhaust valve and the oxygen measuring sensor.

This object and others are achieved according to the invention in that the fuel measuring system regulates an air-fuel mixture in which the masses of fuel and air are such as to satisfy $\lambda=1$, especially $\lambda=1.02$, and, further, in that a second oxygen measuring sensor is disposed in the exhaust side of the engine, which controls a fuel metering process admitting fuel directly into the exhaust gas.

Whenever an air-fuel ratio corresponding to $\lambda= 1.02$ is supplied by the regulator, an internal combustion engine runs satisfactorily and, in any case, very favorably regarding the toxic components, especially carbon monoxide and hydrocarbon compounds. Since the exhaust gas detoxification process takes place essentially on the exhaust side of the engine, it is possible to keep the expenses for fuel metering regulators on the primary side relatively low. Injecting fuel on the secondary (exhaust) side of the engine results in a substantial reduction of nitrogen oxides in the exhaust gas.

Since the quantity of fuel admitted directly to the secondary side of the engine amounts to only approximately 2 percent of the main fuel quantity, a second advantageous embodiment of the invention provides that the fuel quantity admitted to the exhaust side of the engine (secondary side) is precontrolled in throughput-dependent manner by the main fuel metering system on the primary side of the engine.

Further objects and advantages of the invention will become apparent from the following detailed description of the invention taken in conjunction with the drawing.

BRIEF DESCRIPTION OF THE EMBODIMENTS

Figure 1:
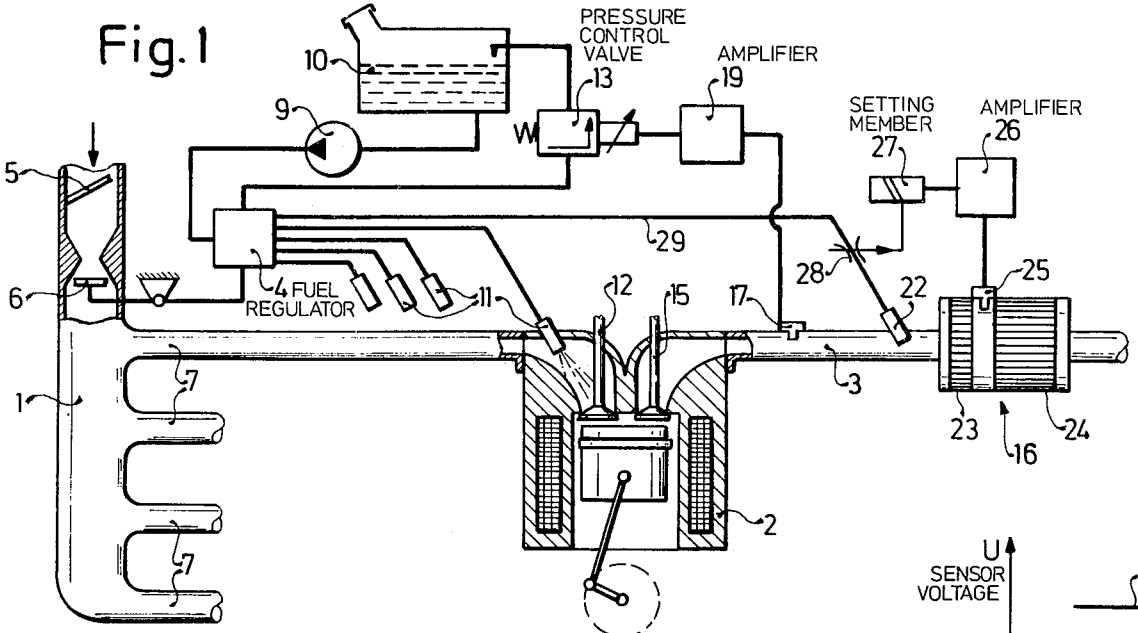
FIG. 1 shows a schematic and cross-sectional view of the entire fuel injection system.

FIG. 1 is a representation of a greatly simplified fuel injection system including a suction tube 1 belonging to an internal combustion engine 2 which includes an exhaust system 3 and a fuel metering system 4. The combustion air aspirated by the internal combustion engine 2 flows past an arbitrarily actuated butterfly valve 5 and an air measuring member 6, both disposed within the suction tube 1. The suction tube 1 branches off into suction tube sections 7 leading to the individual cylinders of the engine. The present example deals with a four-cylinder engine which, accordingly, has four suction tube sections 7. A pump 9 delivers fuel from a fuel reservoir 10 to the fuel metering system 4 where it is metered out to the fuel injection valves 11 which are disposed in the internal combustion engine 2 in the vicinity of the intake valve 12 as is shown in the example of one of the four injection valves. The fuel metering system 4 meters out the same amount of fuel to each of the valves 11, substantially independently of the different opening pressures of these valves, and this amount of fuel corresponds, in each case, to the air quantity aspirated by the engine. This is a known process. The pump 9 delivers more fuel than is actually injected so that a portion of the fuel flows through a pressure control valve 13 and returns to the fuel reservoir 10. The pressurized fluid is also used for resetting the measuring member 6, in a direction opposite to the direction of the air-flow through the suction tube. Whenever the pressure in the pressure control valve 13 is changed, the ratio of the air quantity to the metered-out fuel quantity is also changed.

The combusted exhaust gases flow from the engine 2 through the exhaust valve 15 into the exhaust pipe 3 within which there is installed a double-layer catalyzer 16. A first oxygen measuring sensor 17 is disposed in the exhaust system between the exhaust valve 15 and the catalyzer 16 and this sensor controls the pressure control valve 13.

Figure 2:
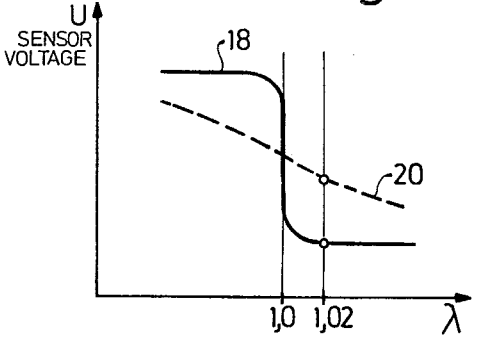
FIG. 2 is a diagram to illustrate the method of operation of the oxygen measuring sensor.

FIG. 2 illustrates the method of operation of an oxygen measuring sensor of this type. The curve 18 is obtained from an oxygen measuring sensor of a known type using a solid electrolyte consisting of zirconium dioxide. A sensor of this type exhibits a sharp bend in the curve when the air number $\lambda$ attains the value $\lambda= 1.0$. As has been stated above, the air number $\lambda$ is defined as being proportional to the ratio of the mass of air to the mass of fuel and it assumes the value $\lambda = 1.0$ when the air-fuel mixture is stoichiometric. Thus, when the air number $\lambda$ is larger than 1.0, the internal combustion engine is being fueled with a leaned-out mixture. According to the invention, the setting of pressure control valve 13 is adjusted only if the actual value of the air number, as measured by the oxygen measuring sensor 17, deviates from the nominal value $\lambda = 1.02$. In that case, and depending on the sense of the deviation, the amplifier 19 causes an increase or a decrease of the control pressure setting within the pressure control valve 13, which alters the ratio of the aspirated air quantity to the metered-out fuel quantity until the nominal value $\lambda = 1.02$ has again been reached. The fuel metering system 4 maintains a somewhat lean mixture as controlled by the oxygen measuring sensor 17. However, an oxygen measuring sensor can be used which has a characteristic shown by the curve 20 in FIG. 2.

The fuel metering system 4 also supplies fuel to a separate injection valve 22 which injects fuel into the hot exhaust gases within the exhaust pipe 3 at a point downstream of the oxygen sensor 17 but upstream of the catalyzer 16. The purpose of this separate and additional injection process is a reduction of the nitrogen oxides on the first layer 23 of catalyst 16. If required, the second layer 24 of the catalyzer serves to oxidize (combust) hydrocarbon compounds and carbon monoxide. For this purpose, a second oxygen measuring sensor 25 is disposed within catalyzer 16, behind layer 23. The output voltage of the sensor 25 is amplified by an amplifier 26 and fed to a setting member 27 which controls a throttle 28 disposed in the fuel line 29 leading from the fuel metering system 4 to the injection nozzle 22. In this way, favorable exhaust gas characteristics are achieved while keeping fuel consumption low. The fuel quantity injected into the exhaust system 3 amounts to approximately 2% of the fuel quantity injected into the primaryr, suction side of the engine. Since the exhaust gas detoxification process takes place substantially on the secondary side of the engine, the dead times of the control loop 25, 26, 27 28 are very small. On the other hand, the large time constants of the other regulating system 17, 19, 13, 4 do not have deleterious effects because the purpose of this regulating system is merely the presetting of a lean air-fuel mixture.

The above description is of preferred embodiments of the invention and modifications may be made thereto without departing from the spirit and scope of the invention.

What is claimed is:

1. A process for the detoxification of the exhaust gases of an internal combustion engine which includes a fuel metering system controlled by a first oxygen measuring sensor disposed in the exhaust system of the engine, comprising the steps of:

a. controlling the fuel metering system so that the ratio of the mass of the air to the mass of the fuel tends to a nominal value for which $\lambda$ equal 1.02;

b. providing exhaust injection means for injecting supplementary fuel into the exhaust system of the engine;

c. providing a second oxygen measuring sensor in the exhaust system of the engine for the purpose of controlling the quantity of fuel injected by said exhaust injection means; and d. adjusting the fuel metering system to precontrol the delivery of fuel to said exhaust injection means in dependence on the fuel-throughput.

2. A process as defined in claim 1, comprising the further additional step of providing a catalyzer for the chemical treatment of the exhaust gases, said catalyzer being located within the exhaust system, and wherein said injection of supplementary fuel into the exhaust system of the engine takes place ahead of said catalyzer.

3. A process as defined in claim 1, wherein the first oxygen measuring sensor, the exhaust injection means and the second oxygen measuring sensor are positioned within the exhaust system of the engine such that said first oxygen measuring sensor is upsteam of said exhaust injection means and said exhaust injection means is upstream of said second oxygen measuring sensor.

* * * * *